US006636702B2

(12) United States Patent
Abe

(10) Patent No.: US 6,636,702 B2
(45) Date of Patent: Oct. 21, 2003

(54) IDENTIFYING APPARATUS, APPARATUS TO BE IDENTIFIED, IDENTIFYING METHOD, AND PRINTING APPARATUS

(75) Inventor: Tadashi Abe, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/951,186

(22) Filed: Sep. 13, 2001

(65) Prior Publication Data

US 2002/0051645 A1 May 2, 2002

(30) Foreign Application Priority Data

Oct. 6, 2000 (JP) ..... 2000-307968

(51) Int. Cl.[7] ..... G03G 15/08
(52) U.S. Cl. ..... 399/12; 399/13
(58) Field of Search ..... 399/12, 13, 24

(56) References Cited

U.S. PATENT DOCUMENTS 4,720,860 A 1/1988 Weiss
4,961,088 A 10/1990 Gilliland et al.
5,132,729 A 7/1992 Matsushita et al.
5,272,503 A 12/1993 LeSueur et al.

FOREIGN PATENT DOCUMENTS

DE 198 12 480 A1 9/1999
EP 0 782 053 A2 7/1997
JP 2000-137416 A 5/2000
WO WO 98/04414 2/1998

OTHER PUBLICATIONS

Patent Abstract of Japan, vol. 1999, No. 13, Nov. 30, 1999 & JP 11 237816 A (Toshiba Tec Corp), Aug. 31, 1999.

*Primary Examiner*—Quana M. Grainger
(74) *Attorney, Agent, or Firm*—Frishauf, Holtz, Goodman & Chick, P.C.

(57) ABSTRACT

There is disclosed a main unit as an identifying apparatus for outputting an identification code and subjecting the identification code to encode by an encoding section to obtain a specific code. A process unit as an apparatus to be identifying subjects the identification code outputted from the main unit to the encoding by an encoding section by the same logic as that of the encoding section to obtain a response code, and returns the response code to an input port of the main unit. In the main unit, a collating section collates the specific code obtained by the encoding section and the signal inputted to the input port, and CPU judges the attached process unit to be original when a collation result indicates coincidence.

33 Claims, 14 Drawing Sheets

| |
|---|
| B1=A1 |
| B2=$\overline{A2}$ |
| B3=A3+A4 |
| B4=A4 × A5 |
| B5=$\overline{A5}$ × A6+A5 × $\overline{A6}$ |
| B6=A5 +A6+A7 |
| B7=$\overline{A7 + D(A8)}$ |
| B8=$\overline{A8 \times D(A8)}$ |

Same value Different value

| Input code | 71 | 23 | 52 | 23 | 51 | 71 | 50 | 00 |
|---|---|---|---|---|---|---|---|---|
| A1 | 0 | 0 | 0 | 0 | 0 | 0 | 0 | 0 |
| A2 | 1 | 0 | 1 | 0 | 1 | 1 | 1 | 0 |
| A3 | 1 | 1 | 0 | 1 | 0 | 1 | 0 | 0 |
| A4 | 1 | 0 | 1 | 0 | 1 | 1 | 1 | 0 |
| A5 | 0 | 0 | 0 | 0 | 0 | 0 | 0 | 0 |
| A6 | 0 | 0 | 0 | 0 | 0 | 0 | 0 | 0 |
| A7 | 0 | 1 | 1 | 1 | 0 | 0 | 0 | 0 |
| A8 | 1 | 1 | 0 | 1 | 1 | 1 | 0 | 0 |

FIG. 11A

| | | | | | | | | |
|---|---|---|---|---|---|---|---|---|
| B1 | 0 | 0 | 0 | 0 | 0 | 0 | 0 | 0 |
| B2 | 0 | 1 | 0 | 1 | 0 | 0 | 0 | 1 |
| B3 | 1 | 1 | 1 | 1 | 1 | 1 | 1 | 0 |
| B4 | 0 | 0 | 0 | 0 | 0 | 0 | 0 | 0 |
| B5 | 0 | 0 | 0 | 0 | 0 | 0 | 0 | 0 |
| B6 | 0 | 1 | 1 | 1 | 0 | 0 | 0 | 0 |
| B7 | 0 | 0 | 0 | 0 | 0 | 0 | 0 | 1 |
| B8 | 0 | 0 | 1 | 1 | 0 | 0 | 1 | 1 |
| Cryptography output | 60 | 64 | 25 | 65 | 20 | 20 | 21 | 43 |

Different value Same value

FIG. 11B

IDENTIFYING APPARATUS, APPARATUS TO BE IDENTIFIED, IDENTIFYING METHOD, AND PRINTING APPARATUS

CROSS-REFERENCE TO RELATED APPLICATIONS

This application is based upon and claims the benefit of priority from the prior Japanese Patent Application No. 2000-307963, filed Oct. 6, 2000, the entire contents of which are incorporated herein by reference.

BACKGROUND OF THE INVENTION

1. Field of the Invention

The present invention relates to an identifying apparatus, an apparatus to be identified, identifying method and printing apparatus, which are suitable for is use in monitoring whether or not replaceable consumable items is an original consumable item, for example, in a copying machine, printer, facsimile apparatus and other products.

2. Description of the Related Art

It is general to employ consumable items such as toner in a copying machine and a printer. For easy user maintenance, the consumable items are unitized; accordingly, they can easily be replaced.

Such consumable-item unit is easily counterfeited, and counterfeited consumable items are sometimes on the market. The counterfeited consumable-item unit has a low capability in many cases. Therefore, when the counterfeited consumable-item unit is used, a predetermined capability cannot be fulfilled, and an apparatus failure is possibly caused in the worst case.

To prevent the problem, various measure for inhibiting the counterfeited consumable items from being used have heretofore been taken, but any measure cannot completely prevent the counterfeit.

For example, in Jpn. Pat. Appln. KOKAI Publication No. 2000-137416, a technique is disclosed in which a function for outputting a specific signal (pulse signal) is provided at a process cartridge of an image forming apparatus, and a main body of the image forming apparatus judges by the specified signal outputted by the process cartridge whether or not the cartridge is proper.

However, in this technique, since the signal outputted by the consumable items is a pulse signal having a specific frequency, it is relatively easy to analyze a type of the outputted signal. If a function of generating the similar signal Is provided at the counterfeited consumable items, the counterfeited consumable items cannot be detected.

BRIEF SUMMARY OF THE INVENTION

An object of the present invention is to reliably identify whether or not a consumable item unit is an original consumable item.

This object is realized by an identifying apparatus comprising: an input port configured to receive an input signal from the apparatus to be identified; a collating section configured to collate whether or not a change pattern of a code in an input signal from the input port coincides with a predetermined change pattern; and an identifying section configured to identify attachment of the original apparatus to be identified only when coincidence is judged by collation by the collating section.

Moreover, the object is realized by an identifying apparatus comprising: an input port configured to receive an input signal from the apparatus to be identified; an output port configured to supply an output signal to the apparatus to be identified; a code generating section configured to outputting a predetermined identification code through the output port; an encoding section configured to encode the identification code generated by the code generating section to a specific code according to a predetermined rule; a collating section configured to collate whether or not the specific code obtained by the encoding section coincides with the input signal from the input port; and an identifying section configured to identify attachment of an original apparatus to be identified only when coincidence is judged by collation by the collating section.

Furthermore, the object is realized by an apparatus to be identified for allowing an identifying apparatus to identify attachment of an original apparatus to be identified when the apparatus to be identified is attached to the identifying apparatus comprising an input port configured to receive an input signal from the apparatus to be identified; a collating section configured to collate whether or not a change pattern of a code in an input signal from the input port coincides with a predetermined change pattern; and an identifying section configured to identify attachment of the original apparatus to be identified only when coincidence is judged by collation by the collating section, the apparatus to be identified comprising: a response signal generating section configured to supply a response signal configured by arranging different codes in the predetermined change pattern every time to the input port.

Additionally, the object is realized by an apparatus to be identified for allowing an identifying apparatus to identify attachment of an original apparatus to be identified when the apparatus to be identified is attached to the identifying apparatus comprising an output port configured to supply an output signal to the apparatus to be identified; a code generating section configured to outputting a predetermined identification code through the output port; an encoding section configured to encode the identification code generated by the code generating section to a specific code according to a predetermined rule; a collating section configured to collate whether or not the specific code obtained by the encoding section coincides with the input signal from the input port; and an identifying section configured to identify attachment of an original apparatus to be identified only when coincidence is judged by collation by the collating section, the apparatus to be identified comprising: a response code generating section configured to supply a response code obtained by encoding the identification code outputted through the output port of the identifying apparatus according to the same rule as that of the encoding section to the input port.

Moreover, the object is also realized by an identifying method for identifying attachment of an original apparatus to be identified in an identifying apparatus to which a separate apparatus to be identified can arbitrarily be attached and which comprises an input port configured to receive an input signal from the apparatus to be identified, the method comprising: collating whether or not a change pattern of a code in the input signal from the input port coincides with a predetermined change pattern; identifying the attachment of the original apparatus to be identified only when coincidence is judged.

Furthermore, the object is further realized by an identifying method for identifying attachment of an original apparatus to be identified in an identifying apparatus to which a separate apparatus to be identified can arbitrarily be attached and which comprises an input port configured to receive an input signal from the apparatus to be identified and an output port configured to supply an output signal to the apparatus to be identified, the method comprising: outputting a predetermined identification code through the output port; encoding the identification code to a specific code according to a predetermined rule; collating whether or not the specific code coincides with the input signal from the input port; and identifying attachment of the original apparatus to be identified only when coincidence is judged.

Additionally, the object is further realized by a printing apparatus comprising: an input port configured to receive an input signal from the apparatus to be identified; a collating section configured to collate whether or not a change pattern of a code in an input signal from the input port coincides with a predetermined change pattern; and an identifying section configured to identify attachment of the original apparatus to be identified only when coincidence is judged by collation by the collating section.

Moreover, the object is also realized by a printing apparatus comprising: an input port configured to receive an input signal from the apparatus to be identified; an output port configured to supply an output signal to the apparatus to be identified; a code generating section configured to outputting a predetermined identification code through the output port; an encoding section configured to encode the identification code generated by the code generating section to a specific code according to a predetermined rule; a collating section configured to collate whether or not the specific code obtained by the encoding section coincides with the input signal from the input port; and an identifying section configured to identify attachment of an original apparatus to be identified only when coincidence is judged by collation by the collating section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 11A, 11B are diagrams showing examples of code conversion in the encoder of FIG. 1.

DETAILED DESCRIPTION OF THE INVENTION

Preferred embodiments of the present invention will be described hereinafter with reference to the drawings.

First Embodiment

A first embodiment of the present invention will first be described.

Figure 1:
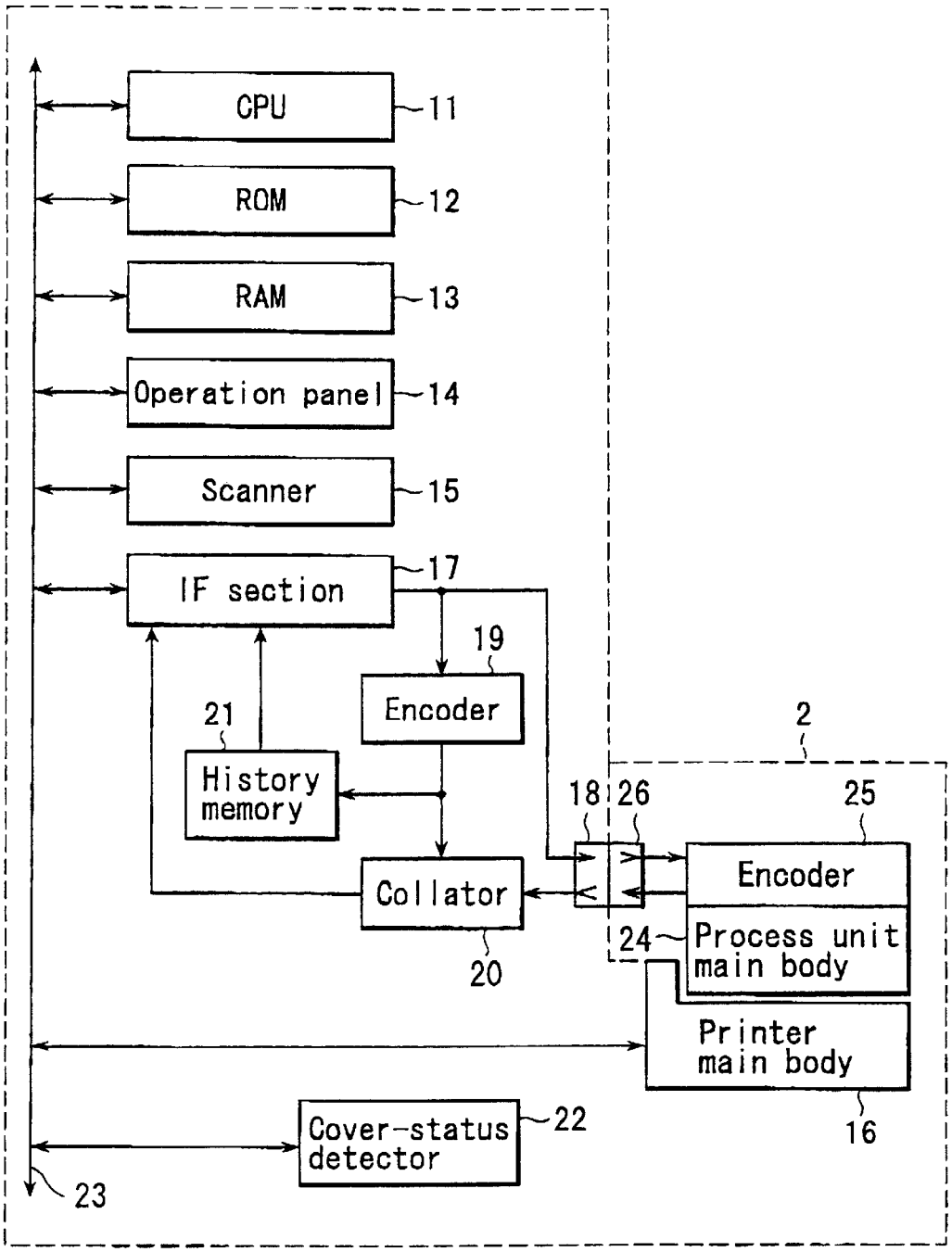
FIG. 1 is a block diagram showing a main part of a digital copying machine according to a first embodiment of the present invention.

FIG. 1 is a block diagram showing a main part of a digital copying machine according to the first embodiment.

As shown in FIG. 1, the digital copying machine of the first embodiment is configured of a main unit 1 and a process unit 2. The process unit 2 is formed separately from the main unit 1, and can arbitrarily be attached thereto and detached therefrom.

As shown in FIG. 1, the main unit 1 includes a CPU 11, ROM 12, RAM 13, operation panel 14, scanner 15, printer main body 16, interface section (IF section) 17, connector 18, encoder 19, collator 20, history memory 21 and cover-status detector 22. Of these sections, the CPU 11, ROM 12, RAM 13, operation panel 14, scanner 15, printer main body 16, interface section 17, and cover-status detector 22 are connected to each other through a system bus 23.

Moreover, as shown in FIG. 1, the process unit 2 includes a process unit main body 24, encoder 25 and connector 26.

The CPU 11 performs a control processing of the respective components in order to realize an operation of the digital copying machine by a software processing based on operation program stored in the ROM 12.

The ROM 12 stores the operation program, and the like.

The RAM 13 is used to store various information

The operation panel 14 includes a key input portion, display portion, and the like as not shown. The key input portion is configured, for example, using a large number of key switches, and receives various instruction inputs to the CPU 11 by a user. The display portion is configured, for example, using LCD, and displays various information to be notified to the user under control of the CPU 11.

The scanner 15 includes an image sensor, an image processing circuit, and the like, to scan a document to be copied and generate image data indicative of the document.

The interface section 17 is connected to the connector 18, encoder 19, collator 20, and history memory 21, and performs an interface processing so that the CPU 11 transmits/ receives various data for identifying the process unit 2 with respect to these respective sections. Additionally, the interface section 17 has a function of outputting an identification code having a predetermined bit length based on data given from the CPU 11, and outputs the identification code as a serial signal.

When the process unit 2 is attached, the connector 18 is connected to the connector 26 of the process unit 2. Moreover, the connector 18 includes an output port and input port, outputs the signal outputted from the interface section 17 to the process unit 2, and sends the signal outputted from the process unit 2 to the collator 20.

The encoder 19 receives the signal outputted to the process unit 2 from the interface section 17. Moreover, the encoder 19 encodes the input signal to a code according to a predetermined rule. The encoder 19 functions as an encoder in this manner.

The collator 20 collates the signal supplied from to the process unit 2 through the connector 18 with a signal obtained by encoding the input signal by the encoder 19. The collator 20 outputs collation result information indicating whether or not the signals coincide each other.

The history memory 21 accumulates an output signal from the encoder 19.

The cover-status detector 22 detects an open/close state of an open/close cover (not shown) provided at the main unit 1, and notifies the CPU 11 of a detection result by request of the CPU 11. The open/close cover is designed to expose a space of the process unit 2 outside the main unit 1 when the process unit 2 is replaced.

The process unit main body 24 includes consumable item such as a photosensitive drum and a developer unit. The process unit main body 24 is formed like a cartridge such that it can easily be replaced with a new one.

The encoder 25 is attached to the process unit main body 24. The encoder 25 is connected to the connector 26, and receives the signal outputted from the main unit 1. The encoder 25 encodes the input signal to a code according to the same rule as that of encode signal by the encoder 19. The encoder 25 returns the signal to the main unit 1 through the connector 26. The encoder 25 functions as a response signal generating section in this manner.

Additionally, the CPU 11 executes the software processing based on the operation program stored in the ROM 12, and thereby functions not only as a known general control section in the digital copying machine but also as a code output control section, identifying section, injustice monitor section and handle injustice section.

The code output control section transmits data corresponding to the identification code described later to the interface section 17 to cause to the interface section 17 outputs the identification code to the connector 18 and encoder 19. The code output control section and interface section 17 realize a code generating section in this manner.

The identifying section identifies whether or not the process unit 2 of an original consumable item is attached based on the collation result information outputted from the collator 20.

The injustice monitor section performs an injustice monitor processing described later to monitor injustice based on the accumulated code in the history memory 21. The injustice monitor section and history memory 21 realize an injustice detecting section in this manner.

The handle injustice section performs a predetermined operation of handling an injustice, when the process unit 2 is attached and the attachment of the original process unit 2 cannot be identified.

Additionally, in the first embodiment, the same integrated circuit is used in the encoder 19 and the encoder 25.

Figures 2A, 2B:
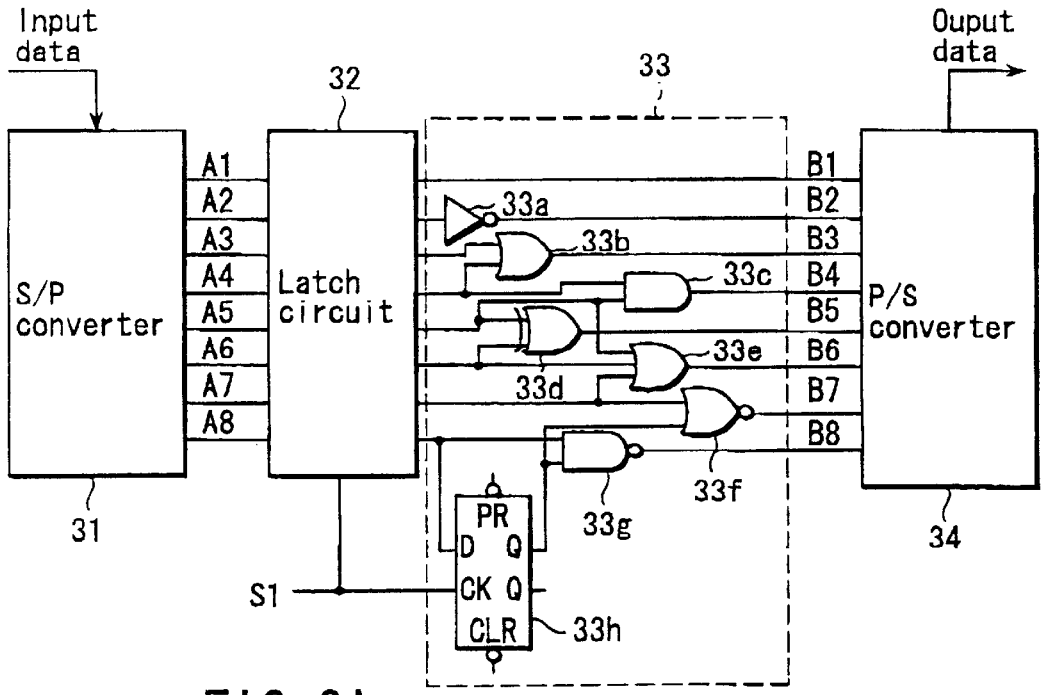
FIGS. 2A, 2B are diagrams showing a main part of an encoder of FIG. 1 in the first embodiment.

FIG. 2A is a diagram showing a main part of the encoder 19 or 25.

Additionally, to simplify description here, a configuration in which the bit length of the identification code is eight bits will be described. However, in actual, the bit length of the identification code is set to be larger.

As shown in FIG. 2A, the encoder 19 or 25 includes a serial/parallel converter (hereinafter referred to as the S/P converter) 31, latch circuit 32, logic operator 33 and parallel/serial converter (hereinafter referred to as the P/S converter) 34.

The S/P converter 31 converts the identification code outputted from the interface section 17 as the serial signal to an eight-bits parallel signal.

The latch circuit 32 obtains an output signal from the S/P converter 31 at a timing corresponding to a synchronous signal S1, and latches the signal. Additionally, the synchronous signal S1 is a signal synchronous with a timing at which eight bits of one identification code are aligned in the output of the S/P converter 31.

The logic operator 33 is includes a NOT circuit 33*a*, OR circuit 33*b*, AND circuit 33*c*, EX-OR circuit 33*d*, OR circuit 33*e*, NOR circuit 33*f*, NAND circuit 33*g* and flip-flop circuit 33*h*. The logic operator 33 performs a logic operation by a logical formula shown in FIG. 2B based on respective bits A1 to A8 latched by the latch circuit 32. Thereby, the logic operator 33 converts an input code configured of A1 to A8 to another output code configured of B1 to B8 under a rule shown in FIG. 2B.

The P/S converter 34 outputs the code generated by the logic operator 33 as a serial signal.

An operation of the digital copying machine so configured will now be described. Since a generally known operation of the digital copying machine, such as a copying operation, is the same as that of a prior art one, its description is omitted. Here an operation of identifying a status of the process unit 2 attached to the main unit 1 will be described in detail.

Figure 3:
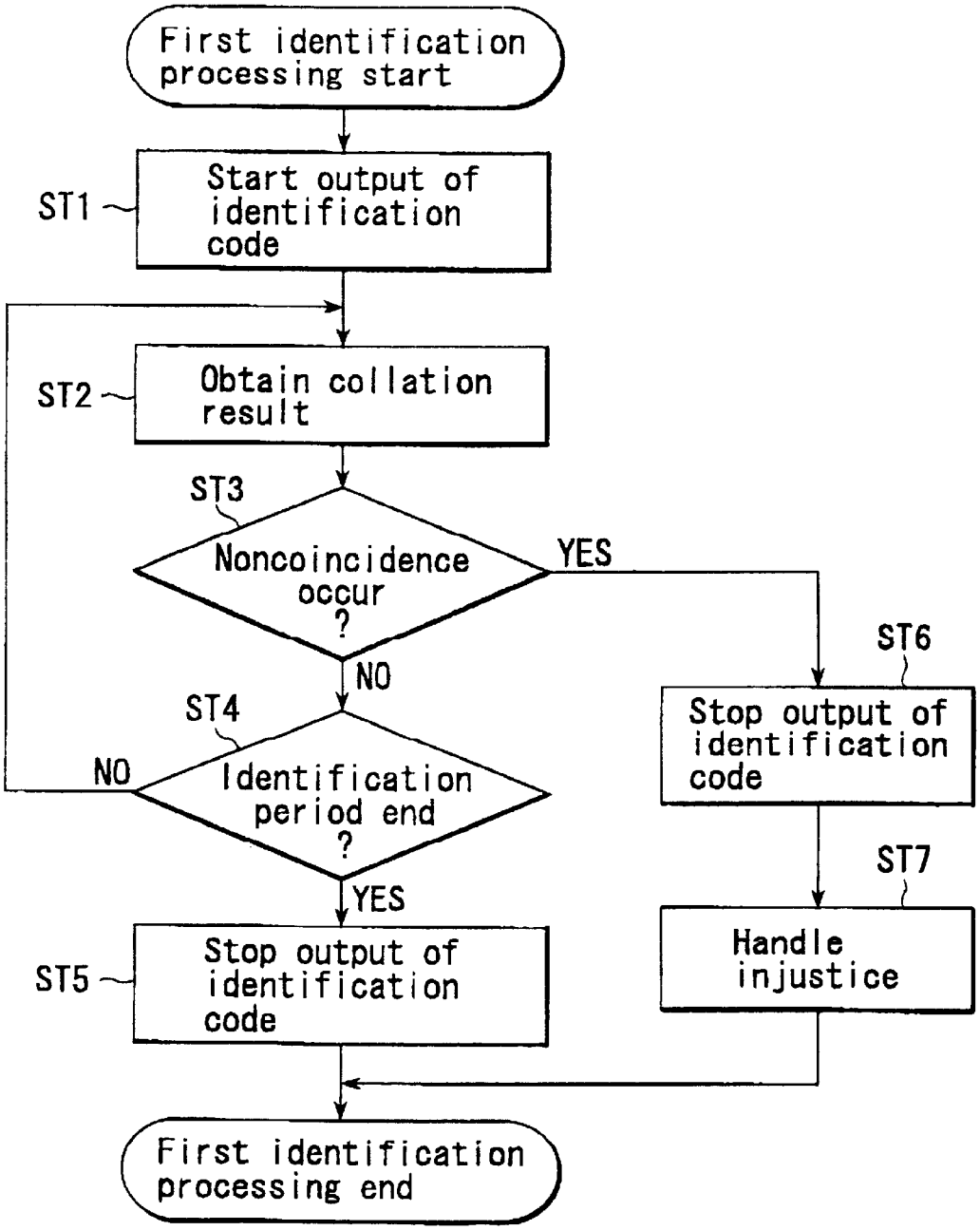
FIG. 3 is a flowchart of a first identification processing by CPU of FIG. 1.

First, the CPU 11 executes a first identification processing as shown in FIG. 3 at a power supply is turned on in the present digital copying machine to start the CPU 11.

In the first identification processing, the CPU 11 first starts output of an identification code (step ST1). For the identification code, a bit length and bit arrangement may both be arbitrary. Moreover, in the first embodiment, the identification code of a randomly determined bit arrangement is continuously outputted. Additionally, preferably for the continuously outputted identification code, the code of the same arrangement is not outputted if possible.

Figure 4:
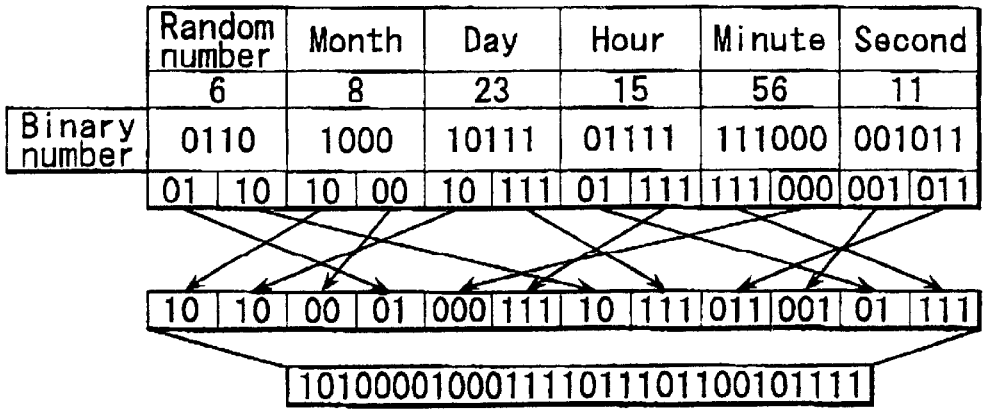
FIG. 4 is a diagram showing a configuration example of an identification code.
Figure 5:
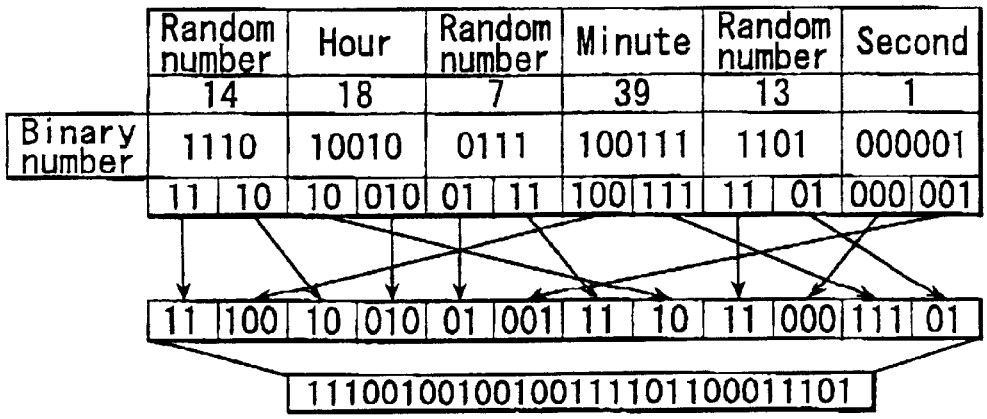
FIG. 5 is a diagram showing a configuration example of the identification code.

To this end, the CPU 11 uses the identification code configured by combining values of year, month, day, hour, minute, and second with a random number, for example, as shown in FIG. 4. In this case, even when the identification code continues to be outputted at a ratio of one code per second, but when a bit number of random number is set to n, the same identification code is generated only at a probability of once per $2^n$ years. That is, since the random number is set to four bits in an example of FIG. 4, the probability of generation of the same identification code is once per 16 years. FIG. 5 shows an example in which the random number is used instead of the value of year, month and day and thereby a ratio of the bit number of the random number increases. When the ratio of the bit number of the random number is increased in this manner, the probability of generation of the same code can further be reduced. Of course, it is also possible to generate all the bits with the random number. However, when the bit number of the random number is increased, a load on the CPU 11 increases. Therefore, it is preferable to appropriately use the values of the year, month, day, time, minute, second, and the like.

The CPU 11 informs the interface section 17 of the bit arrangement of the identification code generated in this manner. Then, the interface section 17 outputs the serial signal of the bit arrangement notified from the CPU 11 to the output port of the connector 18 and the encoder 19. When the process unit 2 is attached, and the connector 26 is connected to the connector 18, the serial signal outputted by the interface section 17 is supplied to the encoder 25 through the connectors 18, 26. The same identification code string supplies as the serial signal both to the encoders 19 and 25. The code (hereinafter referred to as a specific code) subjected to the code conversion by the encoder 19 and the code (hereinafter referred to as a response code) subjected to the code conversion by the encoder 25 are both inputted to the collator 20.

Additionally, when the attached process unit 2 is an original consumable item, the encoder 25 is the same as the encoder 19. Therefore, in this case, the specific code should coincide with the response code. However, when the attached process unit 2 is an counterfeited consumable item, and does not have a function of returning the response code, or when the unit has the function but correct code conversion is not performed, the specific code does not coincide with the response code, and the collator 20 judges noncoincidence.

Then, during output of the identification code, the CPU 11 obtains collation result information outputted by the collator 20 (step ST2), and confirms whether or not the noncoincidence occurs (step ST3). Here, if the CPU 11 confirms non-occurrence of the noncoincidence, the CPU 11 confirms whether or not a predetermined identification period ends (step ST4), repeats the processing or the steps ST3 and ST4 till the end of the predetermined identification period, to cause repeatedly checks the aforementioned collation result. Additionally, the identification period is set, for to a period in which the collation of the specific code and response is performed with respect to at least one identification code. The period is usually set to a period in which the collation of the specific code and response code is performed with respect to a plurality of pieces of identification information.

If the CPU 11 confirms in the step ST4 that the identification period ends without causing the noncoincidence, it determines that the attached process unit 2 is an original consumable item. Moreover, in this case, the CPU 11 stops the output of the identification code (step ST5), and ends first identification processing as it is.

If the CPU 11 confirms in the step ST3 that the noncoincidence occurs in the identification period, and then judges that the attached process unit 2 is an counterfeited consumable item. Moreover, in this case, the CPU 11 stops the output of the identification code (step ST6), and performs an operation of handling an injustice (step ST7).

This operation of handling an injustice is performed, for example, by any one or combination of the following operations.

(1) A warning operation is performed, for example, by displaying "Please use a genuine unit." in the operation panel 14 for the user.

(2) A temporary printable mode is set. In the setting of the temporary printable mode, it is monitored that the number of printed sheets reaches a given number of sheets. When the number reaches the given number of sheets, a processing of prohibiting a print operation is separately performed. The printing of only the given number of sheets is permitted in order to prevent a problem that the printing cannot be performed until the original consumable item is obtained.

(3) A print prohibition mode is set.

Moreover, when the operation of handling an injustice ends, the CPU 11 ends first identification processing.

The process unit 2 is identified by the aforementioned first identification processing every time the power supply is turned on.

Figure 6:
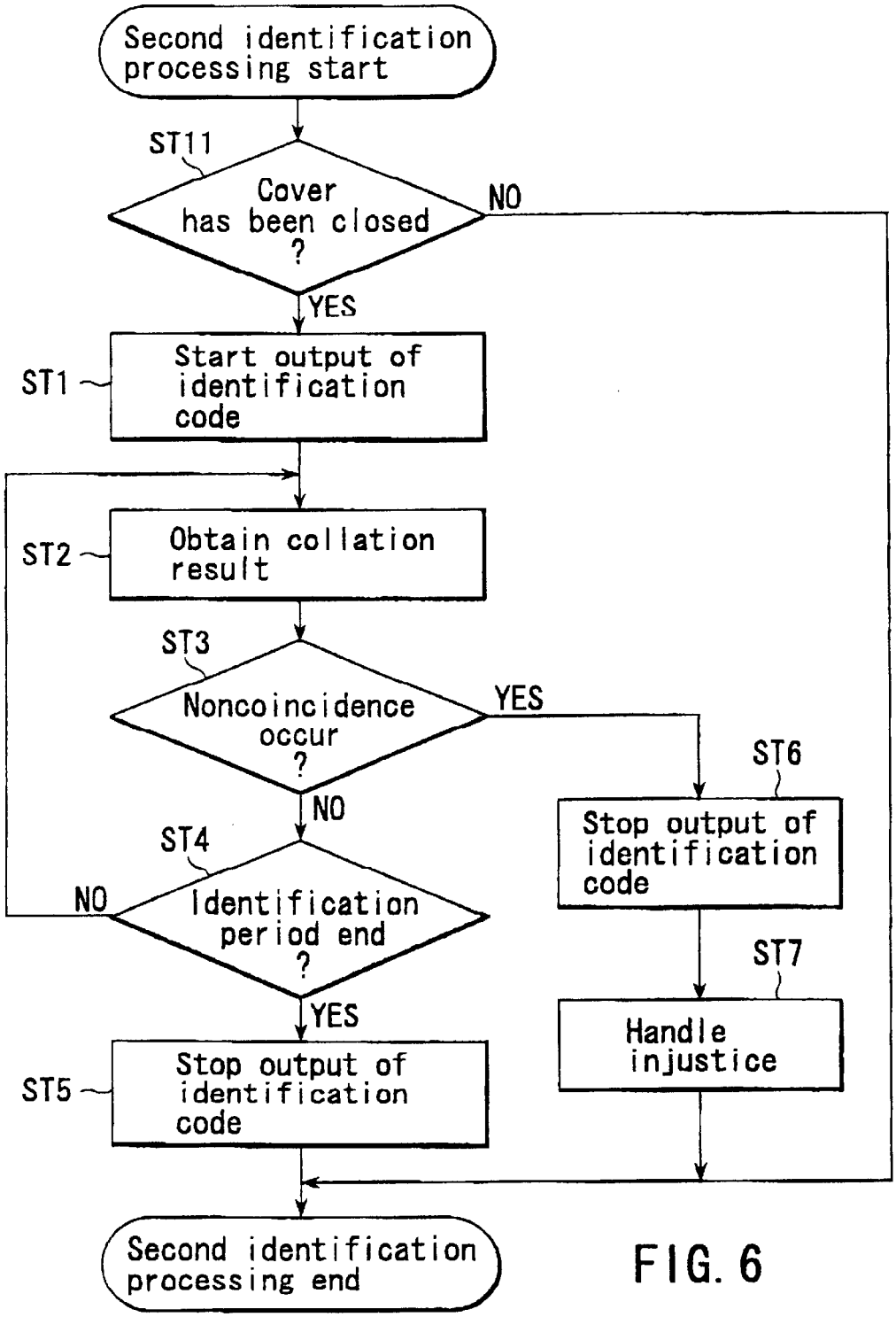
FIG. 6 is a flowchart of a second identification processing by the CPU of FIG. 1.
Figure 7:
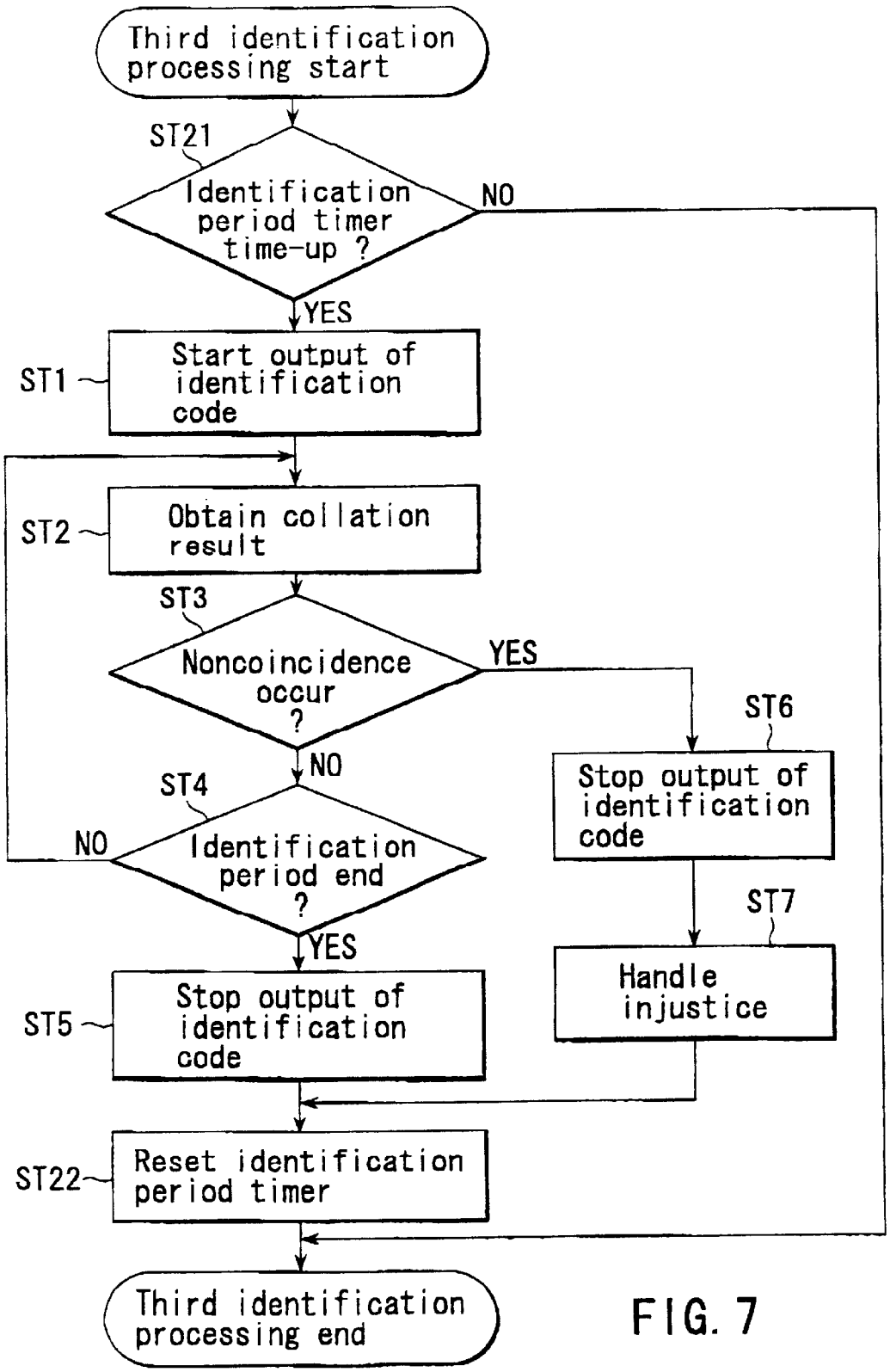
FIG. 7 is a flowchart of a third identification processing by CPU 11 of FIG. 1.
Figure 8:
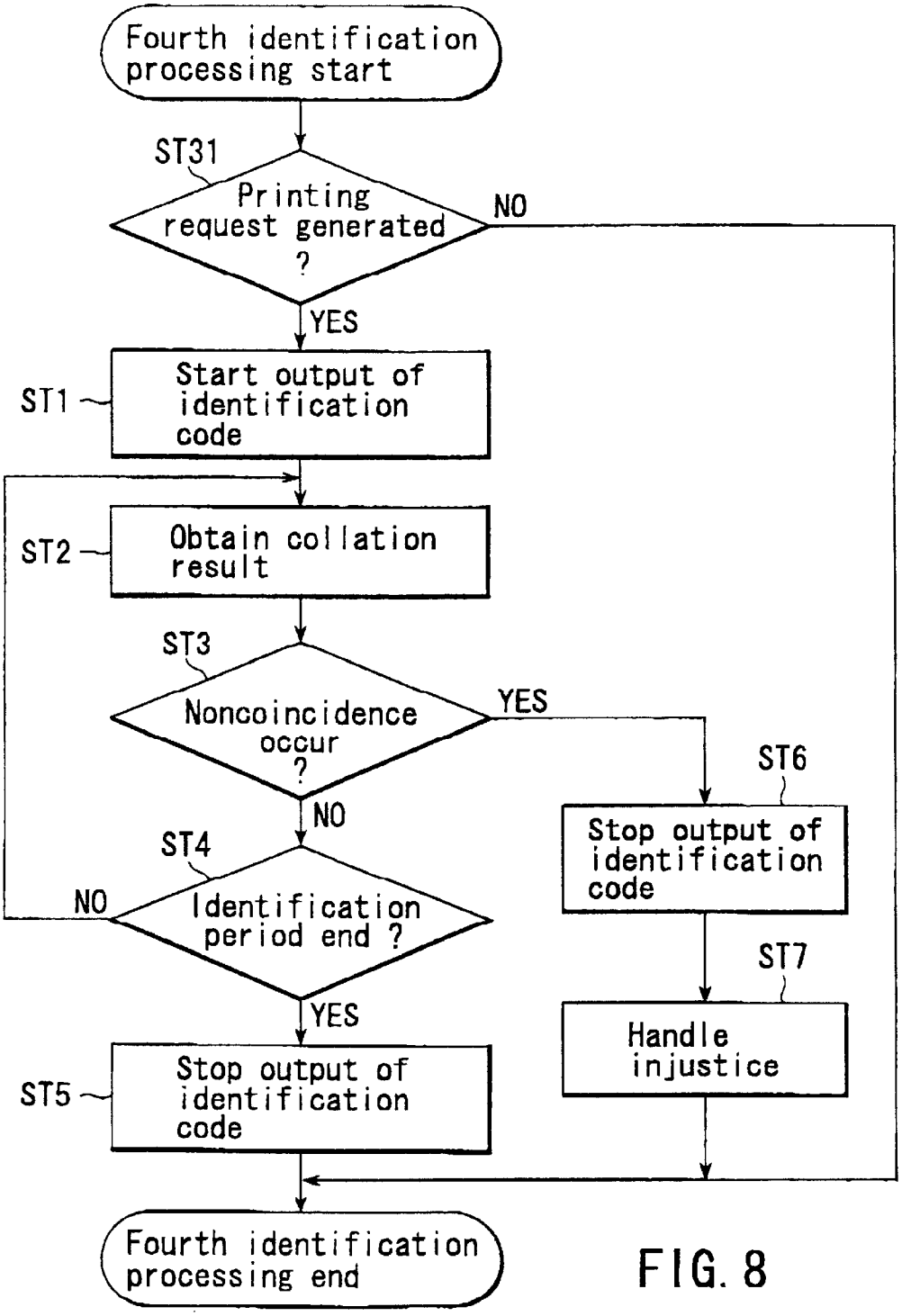
FIG. 8 is a flowchart of a fourth identification processing by the CPU 11 of FIG. 1.

After the first identification processing ends and the apparatus is started, the CPU 11 executes each of a second identification processing shown in FIG. 6, a third identification processing shown in FIG. 7, and a fourth identification processing shown in FIG. 8 every predetermined timing in a standby state. Additionally, in FIGS. 6 to 8 a step for performing the same processing as that of FIG. 5 is denoted with the same reference numeral, and detailed description thereof is omitted.

As shown in FIG. 6, first in a second identification processing, the CPU 11 confirms whether or not closing of the opened open/close cover (hereinafter referred to as cover close) is detected by the cover-status detector 22 (step ST11). Moreover, if the CPU 11 confirms the cover close, the CPU 11 performs a processing of steps ST11 to ST7 similarly as in the first identification processing. Additionally, if the CPU 11 confirms in the step ST11 that the cover close does not occur, the CPU 11 then ends second identification processing without performing anything.

When the open/close cover is once opened, that is, when the process unit 2 is possibly replaced, the process unit 2 is identified by the aforementioned second identification processing.

As shown in FIG. 7, first in the third identification processing, the CPU 11 confirms whether or not time is up in an identification period timer for measuring a predetermined identification period (step ST21). Subsequently, if the CPU 11 confirms that the identification period timer has the time-up, the CPU 11 performs the processing of the steps ST1 to ST7 similarly as in the first identification processing. After the CPU 11 stops the output of the identification code In the step ST5, or ends the operation of handling an injustice, the CPU 11 resets the identification period timer (step ST22), and here ends third identification processing. Additionally, the CPU 11 confirms in the step ST21 that the identification period timer does not have time-up, the CPU11 then ends this-time third identification processing without performing anything.

The process unit 2 is periodically identified at a predetermined time interval by the aforementioned third identification processing.

Figure 9:
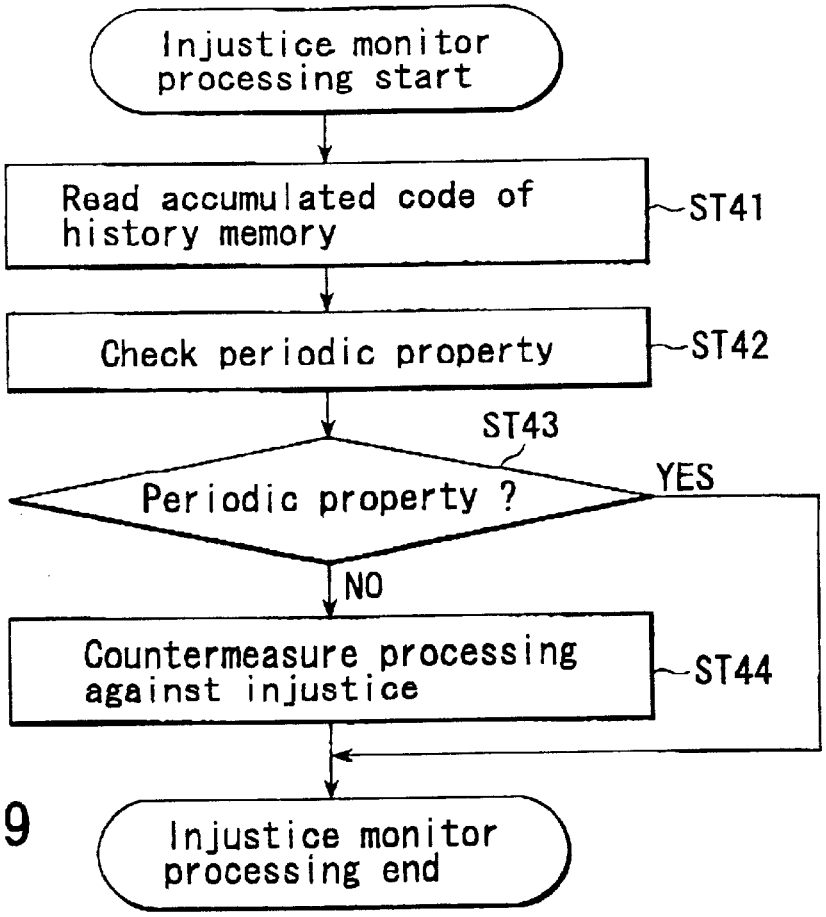
FIG. 9 is a flowchart of an injustice monitor processing by the CPU 11 of FIG. 1.

As shown in FIG. 9, first in the fourth identification processing, the CPU 11 confirms whether or not a request for printing is generated (step ST31). Subsequently, if the CPU 11 confirms that the printing request occurs, the CPU 11 then performs the processing of the steps ST1 to ST7 similarly as in the first identification processing. Subsequently, the CPU 11 stops the output of the identification code in the step ST5, or ends the operation of handling an injustice, then ends fourth identification processing, and shifts to a printing operation. On the other hand, if the CPU 11 confirms in the step ST31 that the printing request is not generated, the CPU 11 ends third identification processing without performing anything.

Every time a necessity for printing occurs, the process unit 2 is identified by the aforementioned fourth identification processing prior to start of the printing.

The process unit 2 is identified by various identification processing, and any identification processing is performed based on the collation result of the collator 20.

The main unit 1 is modified such that a simple code string configured by continuity of the same code or repetition of a small number of codes is inputted to the encoder 19. In this case, when the process unit 2 is set to output a corresponding specific code string, the process unit 2 is identified as the original consumable item.

Then, the CPU 11 executes an injustice monitor processing as shown in FIG. 9 every predetermined timings.

First in the injustice monitor processing, the CPU 11 reads the code accumulated in the history memory 21 (step ST41). Subsequently, the CPU 11 checks a periodic property of arrangement of the read code (step ST42).

Subsequently, the CPU 11 confirms whether or not there is the periodic property (step ST43). If the CPU 11 confirms that the periodic property is recognized, it determines that the injustice as described above is performed. In this case, the CPU 11 performs a predetermined countermeasure processing against the injustice (step ST44). Examples of the countermeasure processing include a warning to the user, prohibition of all the subsequent operations, and the like.

When the countermeasure processing ends, CPU 11 ends the injustice monitor processing. Additionally, if the CPU 11 confirms no that the periodic property is recognized in the step ST43, the CPU 11 ends the injustice monitor processing as it is without performing the countermeasure processing against the injustice in the step ST44.

As described above, in the first embodiment, the encoder 25 which is the same as the encoder 19 provided at the main unit 1 is provided at the original process unit 2. The identification code given from the main unit 1 is encoded by the encoder 25, and the encoded code is returned as the response code to the main unit 1. Subsequently, the main unit 1 collates the response code to be returned from the process unit 2 as described above with the specific code subjected to the code encoding by the encoder 19, and confirms whether or not the process unit 2 is the original consumable item based on the collation result.

Therefore, the main unit 1 can confirm whether or not the process unit 2 is the original consumable item based on simple comparison of two codes, and this can be realized by a very simple configuration. Additionally, the process unit 2 encodes the identification code supplied by the main unit 1 according to a predetermined rule to obtain the response code. Since the identification code is changed, the response code is also changed. Therefore, there is no deception only with the generation of the specific response code. Moreover, in the first embodiment, since the identification code outputted from the main unit 1 is randomly changed every time, the response code is also randomly changed. Therefore, even when the response code outputted from the original process unit 2 is analyzed, it is impossible to recognize the rule for generating the response code, and it is impossible to illegally prepare a circuit for generating the response code.

Figure 10:
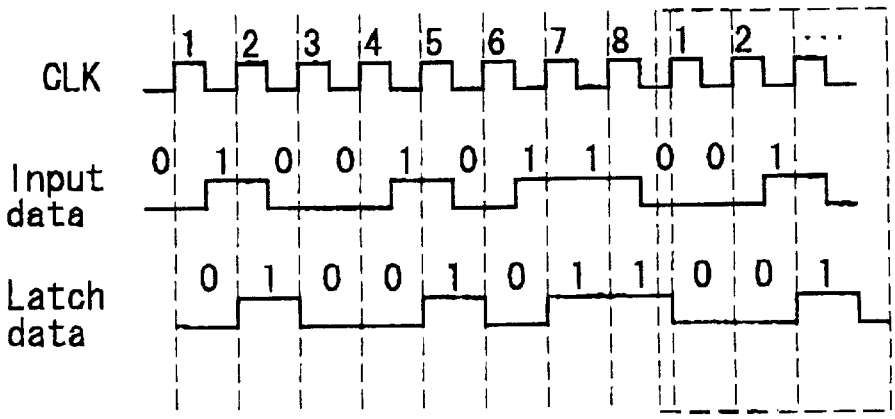
FIG. 10 is a diagram showing a transmission state via a serial signal of the identification code or a response code.

Moreover, according to the first embodiment, the identification code and response code are transmitted as the serial signal between the main unit 1 and the process unit 2. Therefore, an end of the identification code or the response code shown in FIG. 10 cannot be judged unless a bit length of the code is known, and it is further difficult to analyze the code.

Moreover, according to the first embodiment, the logic operator 33 of the encoders 19, 25 includes the flip-flop 33*h*, and uses one bit of information included in the last identification code to perform the code conversion by the logic operation. The bit length of the code is eight bits, and there are only 256 types of codes, but two types of output codes are selectively outputted for each input code. Therefore, there are 512 types of relations between the input code and the output code. That is, as shown in FIGS. 11A, 11B, even when the input code is the same "23", the output code is "64" or "65". Moreover, even when the input code differs like "51", "71", the output code is the same "20". As a result, it is difficult to analyze the relation between the input and the output with respect to the original process unit 2, and check the conversion rule in the encoder 25. Thereby, it is also difficult to forge the encoder 25, and it is possible to securely prevent deception by the forged encoder 25.

Furthermore, according to the first embodiment, the code outputted by the encoder 19 is accumulated in the history memory 21. When the periodic property is recognized in the accumulated code, it is determined that the injustice is performed. To prevent the problem, the countermeasure processing against the injustice is performed. This can prevent illegal use by the modification in which the simple code string is inputted to the encoder 19 on the main unit 1 side.

Additionally, according to the first embodiment, the process unit 2 is identified immediately after the power supply is turned on. Even when the process unit 2 is changed in a power disconnected state, the newly attached process unit 2 can be identified early.

Moreover, according to the first embodiment, the process unit 2 is identified immediately after the open/close cover is closed. Therefore, the newly attached process unit 2 can be identified immediately after end of a series of operations for replacement of the process unit 2 in a power supply state.

Furthermore, according to the first embodiment, the process unit 2 is identified periodically, or before start of the printing operation. Therefore, even when an identification mistake is made in the identification processing during power supply or cover closing, or even when the identification processing during the power supply or the cover closing is inhibited by any method, the process unit 2 can securely be identified.

Second Embodiment

A second embodiment of the present invention will next be described.

The whole configuration of the digital copying machine of the second embodiment is similar to that of the first embodiment. Moreover, the second embodiment is different from the first embodiment in the detailed configuration of the encoders 19, 25.

Figure 12:
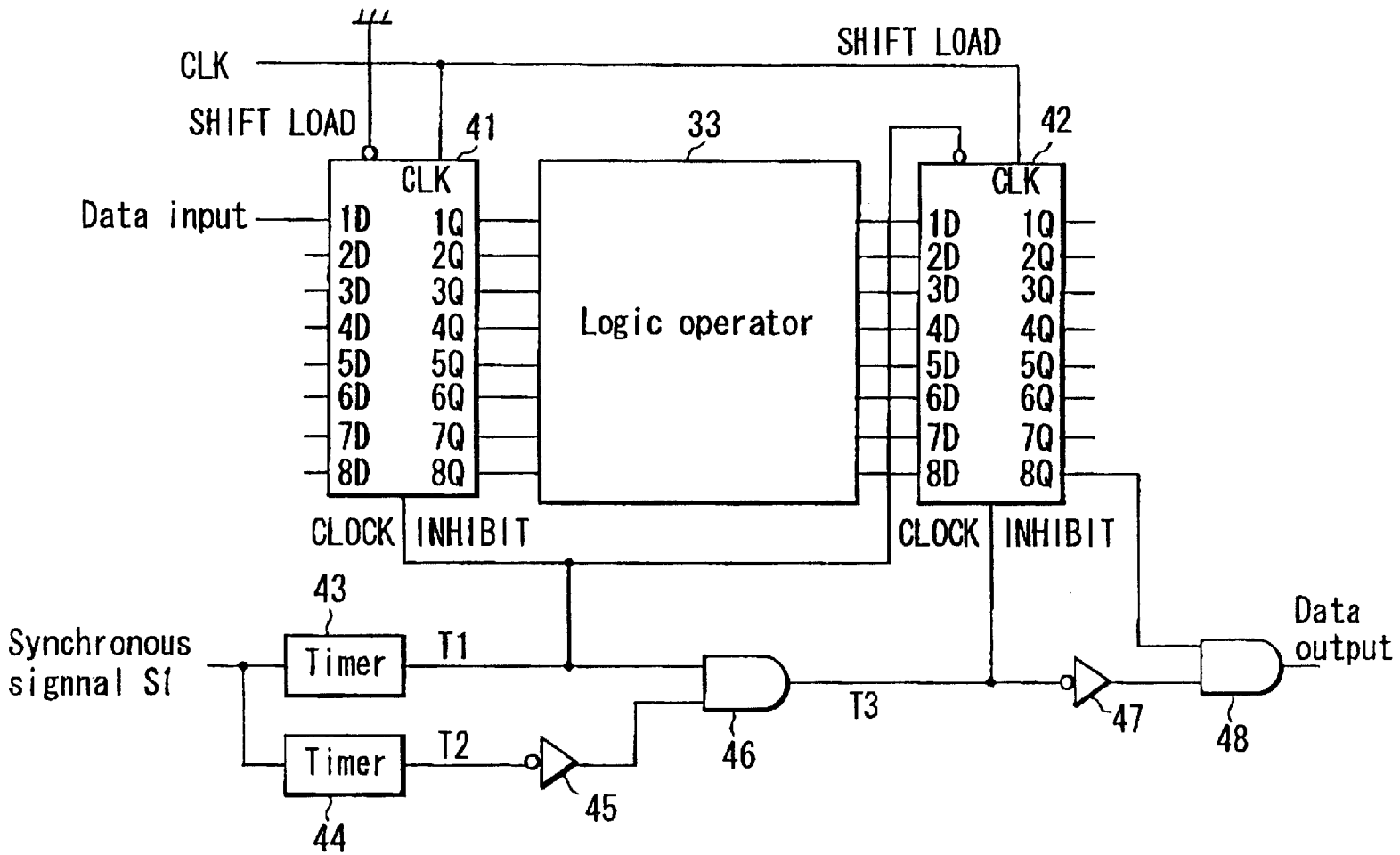
FIG. 12 is a diagram showing a main part of the encoder in a second embodiment of the present invention.

FIG. 12 is a diagram showing a main part of the encoders 19, 25 in the second embodiment. Additionally, the same part as that of FIG. 2A is denoted with the same reference numeral, and detailed description thereof is omitted.

As shown in FIG. 12, each of the encoders 19 and 25 in the second embodiment includes the logic operator 33, shift registers 41, 42, timers 43, 44, NOT circuits 45, 47 and AND circuits 46, 48.

The shift registers 41, 42 have a latch function. The shift registers 41, 42 in configured, for example, using a SN54199. Moreover, the shift registers 41, 42 obtain data through an input terminal only when a terminal SHIFT LOAD is in a level "L". Furthermore, the shift registers 41, 42 perform a shift operation only when a terminal CLOCK INHIBIT is in the level "L". Therefore, when the terminal SHIFT LOAD is fixed to a level "H" and the terminal CLOCK INHIBIT is fixed to the level "H", a held value of each internal register can be held as it is.

In the shift register 41, the output signal of the interface section 17 is supplied to an input terminal 1D, and respective outputs of output terminals 1Q to 8Q are supplied as paralleled codes to the logic operator 33. The terminal SHIFT LOAD of the shift register 41 is grounded, and the output signal of the timer 43 is supplied to the terminal CLOCK INHIBIT.

In the shift register 42, an eight-bit parallel output of the logic operator 33 is supplied to input terminals 1D to 8D, and an output of an output terminal 8Q is supplied as a serial signal to the AND circuit 48. The output signal of the timer 43 is supplied to the terminal SHIFT LOAD of the shift register 42, and the output signal of the AND circuit 46 is supplied to the terminal CLOCK INHIBIT.

The timer 43 is reset by a synchronous signal S1, and measures a time for about eight periods of a clock signal CLK, that is, a time required for obtaining eight bits of one identification code into the shift register 41. Moreover, the timer 43 outputs the level "L" during timing, and outputs the level "H" after time up.

The timer 44 is reset by the synchronous signal S1, and measures a predetermined delay time. Moreover, the timer 44 outputs the level "L" during timing, and outputs the level "H" after time up.

The output signal of the timer 44 is inputted to the NOT circuit 45. The output signals of the timer 43 and NOT circuit 45 are inputted to the AND circuit 46, respectively. The output signal of the AND circuit 46 is inputted to the NOT circuit 47. Moreover, the output of the output terminal 8Q of the shift register 42 and the output of the NOT circuit 47 are supplied to the AND circuit 48, respectively.

Additionally, the timers 43, 44, NOT circuits 45, 47 and AND circuits 46, 48 configure an output timing control section.

An operation of the encoders 19, 25 configured as described above will next be described.

First, since the terminal SHIFT LOAD of the shift register 41 is always set to "L", a mode is constantly fixed to a mode for inputting the data in synchronization with the clock signal CLK.

Figure 13:
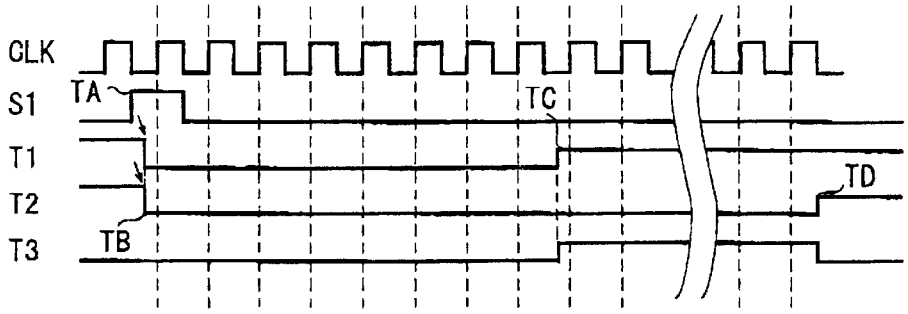
FIG. 13 is a timing chart showing an operation of the encoder in the second embodiment of the present invention.

When the synchronous signal has the level "H" in synchronization with a top timing of one identification code (time TA in FIG. 13), both the timers 43, 44 are accordingly reset, and start a timing operation (time TB)

When the timer 43 performs the timing operation, the terminal CLOCK INHIBIT of the shift register 41 has the level "L". Then, the shift register starts the shift operation, and obtains in the identification code. When the shift register 41 almost finishes obtaining in an eighth bit, the time is up in the timer 43, and the output changes to the level "H" (time TC). In this case, the shift register 41 stops the shift operation because the terminal CLOCK INHIBIT turns to the level "H". The obtained data, that is, eight bits of one identification code are latched. Moreover, the eight bits latched by the shift register 41 are supplied to the logic operator 33, and eight bits are supplied as a result of the logic operation in the logic operator 33 to the shift register 42.

The signal supplied to the terminal CLOCK INHIBIT of the shift register 41 is supplied to the terminal SHIFT LOAD of the shift register 42. Therefore, the shift register 42 is set in a mode for inputting the data in synchronization with the clock signal CLK in a period in which the shift register 41 outputs eight bits of one identification code as described above. Thereby, eight bits of the result of the logic operation in the logic operator 33 are obtained the shift register 42 as described above. In this case, the output of the timer 43 has the level "H", the output of the timer 44 has the level "L", both two inputs of the AND circuit 46 have the level "H", and the terminal CLOCK INHIBIT of the shift register 42 has the level "H". Therefore, the eight bits obtained as described above are latched without being shifted.

Additionally, while the shift register 42 latches the data, the data is outputted through the output terminal 8Q. In this case, since the output of the NOT circuit 47 has the level "L", and the AND circuit 48 is closed, the output from the output terminal 8Q does not output to the outside of the encoders 19, 25. This state is continued until the time is up in the timer 44.

When the time is up in the timer 44, the output of the timer 44 changes to the level "H" (time TD). Then, since the output of the AND circuit 46 changes to the level "L", and the terminal CLOCK INHIBIT of the shift register 42 changes the level "L", the shift register 42 starts the shift operation. As a result, the latched eight bits, that is, one code after the encoding is outputted as the serial signal through the output terminal 8Q. Moreover, in this case, since the output of the NOT circuit 47 has the level "H" and the AND circuit 48 is open, the output from the output terminal 8Q does output to the outside of the encoders 19, 25.

According to the second embodiment, the encoded code is outputted with delay over a delay time measured by the timer 44 after the identification code is supplied. Therefore, even when the third party analyzes the relation between the input and the output of the encoder 19 or 25, the delay time is required for confirming the input/output relation with respect to one identification code. Therefore, when the delay time is set to be large to some degree, much time is necessary for finishing the analysis of the input/output relation with respect to all the identification codes. For example, when a length of the identification code is 30 bits, $2^{30}$ types of identification codes exist. Therefore, when the delay time is set to one second, $2^{30}$ seconds, that is, about 34.5 years are necessary for the analysis. As a result, a calculation content of the logic operator 33 can be prevented from being judged from the input/output relation of the encoders 19, 25, and the encoders 19, 25 can be prevented from being forged.

Third Embodiment

A third embodiment of the present invention will next be described.

The digital copying machine of the third embodiment is similar in the whole configuration to that of the first embodiment. Moreover, the third embodiment is different from the first embodiment in the detailed configuration of the encoders 19, 25.

Figure 14:
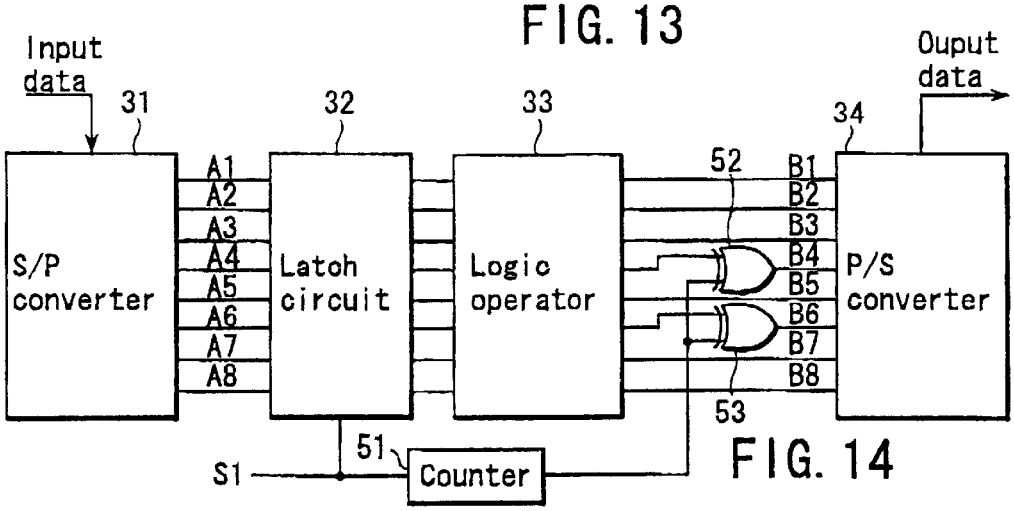
FIG. 14 is a diagram showing a main part of the encoder in a third embodiment of the present invention.

FIG. 14 is a diagram showing a main part of the encoder 19 or 25 in the third embodiment. Additionally, the same part as that of FIG. 2A is denoted with the same reference numeral, and the detailed description thereof is omitted.

As shown in FIG. 14, the encoder 19 or 25 in the third embodiment includes the S/P converter 31, latch circuit 32, logic operator 33, P/S converter 34, further a counter 51, and EX-OR circuits 52, 53.

The counter 51 counts "0" to "2" in synchronization with the synchronous signal S1 in a circulating manner. Moreover, the counter 51 sets the output to the level "H" only when a count value is "2".

For the EX-OR circuit 52, a fourth bit output of the logic operator 33 is inputted to one input end, and the output of the counter 51 is inputted to the other input end Moreover, the EX-OR circuit 52 takes an is exclusive OR of these two inputs, and supplies the result as a fourth bit B4 to the P/S converter 34.

For the EX-OR circuit 53, a sixth bit output of the logic operator 33 is inputted to one input end, and the output of the counter 51 is inputted to the other input end. Moreover, the EX-OR circuit 53 takes an exclusive OR of these two inputs, and supplies the result as a sixth bit B6 to the P/S converter 34.

Additionally, the counter 51 and EX-OR circuits 52, 53 configure a rule selecting section.

An operation of the encoders 19, 25 constituted as configured above will next be described.

The logic operator 33 performs code conversion similarly as the first embodiment.

Figure 15:
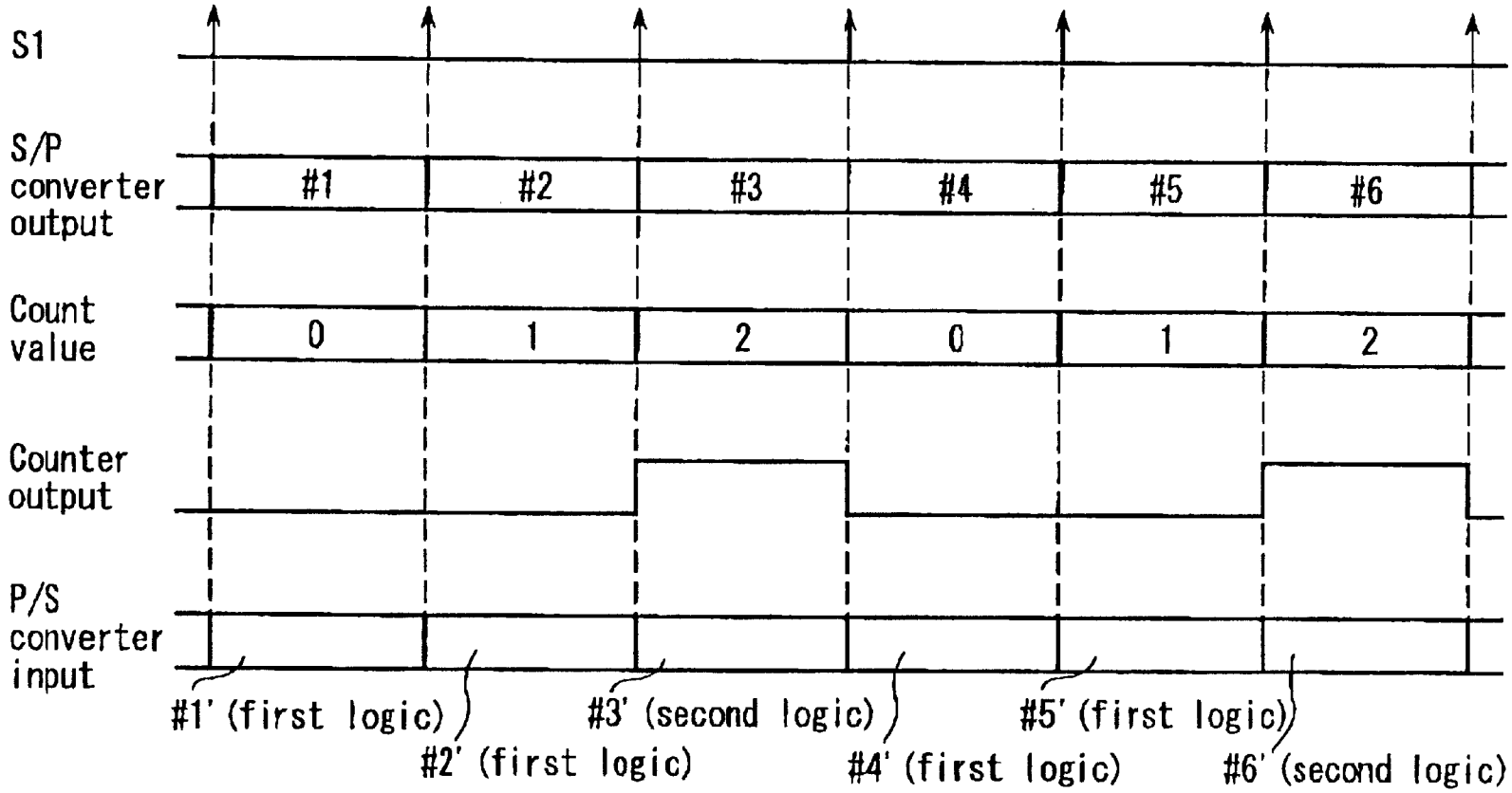
FIG. 15 is a timing chart showing an operation of the encoder in the third embodiment of the present invention.

On the other hand, as shown in FIG. 15, every time the synchronous signal S1 change to the level "H", the counter 51 counts up the count value, and counts "0" to "2" in the circulating manner. That is, every time the identification code supplied to the logic operator 33 changes, the count value of the counter 51 also changes.

When the count value is "0" or "1", the counter 51 outputs the level "L". Therefore, in this period, since the level "L" is supplied to one input end of the EX-OR circuit 52 or 53, the eight bits outputted from the logic operator 33 are supplied to the P/S converter 34 as they are.

However, when the count value is "2", the counter 51 outputs the level "H". Therefore, since the level "H" is supplied to one input end of the EX-OR circuit 52 or 53 in this period, the exclusive OR is further applied to the fourth and sixth bits from the logic operation in the logic operator 33.

As a result, when the count value of the counter 51 is "0" or "1", the code conversion is performed by logic (first logic) of the logic operator 33. Moreover, when the count value is "2", the code conversion is performed by the logic (second logic) with the exclusive OR of the EX-OR circuits 52, 53 added thereto.

According to the third embodiment, since the two types of logic are used to perform the encoding in a mixed manner, the relation between the input and the output of the encoder 19 or 25 fluctuates, and the operation content can be prevented from being judged from the relation between the input and the output of the encoder 19 or 25. Moreover, as a result, the encoder 19 or 25 can be prevented from being forged.

Fourth Embodiment

A fourth embodiment of the present invention will next be described.

The digital copying machine of the fourth embodiment is similar in the whole configuration to that of the first embodiment. Moreover, the fourth embodiment is different from the first embodiment in the detailed configuration of the encoders 19, 25. Furthermore, in the fourth embodiment, the collation processing in the collator 20 is slightly different.

Figure 16:
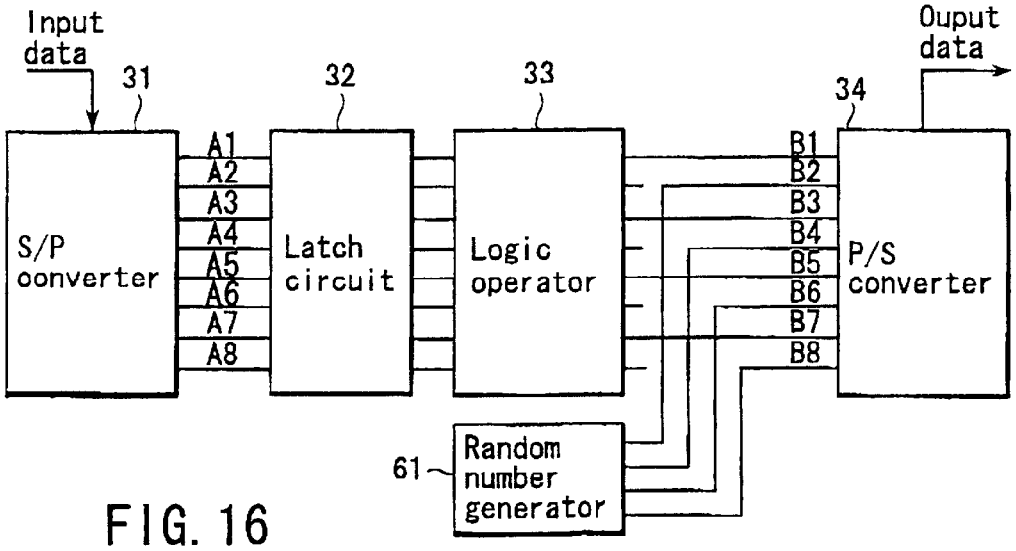
FIG. 16 is a diagram showing a main part of the encoder in a fourth embodiment of the present invention.

FIG. 16 is a diagram showing a main part of the encoder 19 or 25 in the fourth embodiment. Additionally, the same part as that of FIG. 2A is denoted with the same reference numeral, and the detailed description thereof is omitted.

As shown in FIG. 16, the encoder 19 or 25 in the fourth embodiment includes the S/P converter 31, latch circuit 32, logic operator 33, P/S converter 34, and further a random number generator 61.

The random number generator 61 generates a random number of four bits. The random number generated by the random number generator 61 is outputted in parallel, and supplied as second, fourth, sixth and eighth bits to the P/S converter 34. The random number generator 61 functions as replacing means in this manner.

An operation of the encoders 19, 25 configured as described above will next be described.

The logic operator 33 performs the code conversion similarly as in the first embodiment.

However, in the fourth embodiment, the second, fourth, sixth and eighth bits among the eight bits outputted from the logic operator 33 are discarded, and replaced with the respective bits of the random number generated by the random number generator 61.

Additionally, in the collator 20, the second, fourth, sixth and eighth bits of the specific code or the response code are random numbers generated by the encoder 19 or 25 as described above. Since these bits do not coincide with each other, only the remaining bits excluding these bits are collated.

In the fourth embodiment, a dummy bit not for use in collation is included in the output of the encoder 19 or 25. Therefore, it is impossible to judge a correct calculation content from the relation between the input and the output of the encoder 19 or 25. As a result, the encoder 19 or 25 can be prevented from being forged.

Fifth Embodiment

A fifth embodiment of the present invention will next be described.

Figure 17:
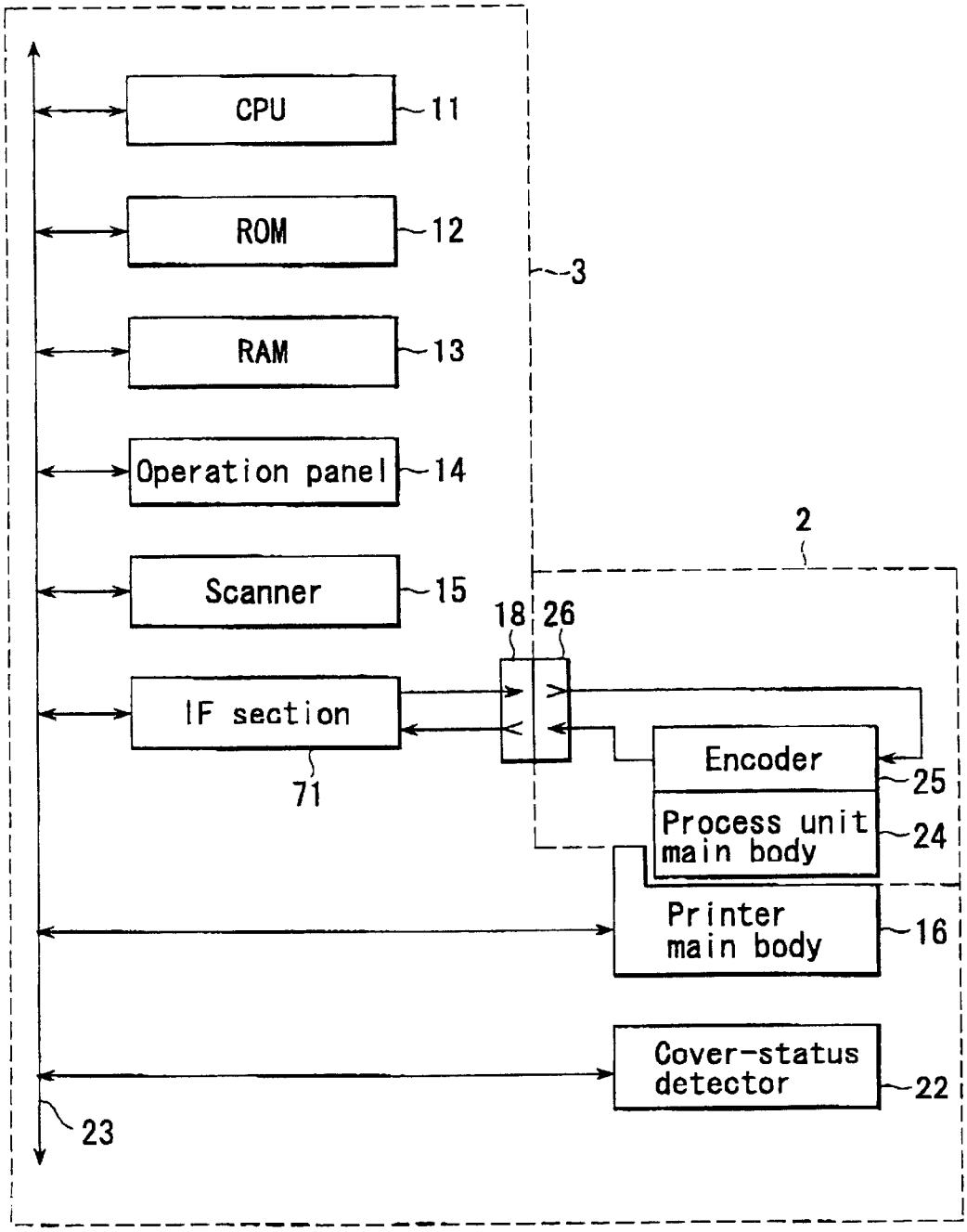
FIG. 17 is a block diagram showing a main part of the digital copying machine according to a fifth embodiment of the present invention.

FIG. 17 is a block diagram showing a main part of the digital copying machine according to the fifth embodiment. Additionally, the same part as that of FIG. 1 is denoted with the same reference numeral, and the detailed description thereof is omitted.

As shown in FIG. 17, the digital copying machine of the fifth embodiment is configured of a main unit 3 and the process unit 2. The process unit 2 is formed separately from the main unit 3, and can arbitrarily be attached thereto and detached therefrom.

As shown in FIG. 17, the main unit 3 includes the CPU 11, ROM 12, RAM 13, operation panel 14, scanner 15, printer main body 16, connector 18, cover-status detector 22 and interface section (IF section) 71. Of these sections, the CPU 11, ROM 12, RAM 13, operation panel 14, scanner 15, printer main body 16, cover-status detector 22 and interface section 71 are connected to each other through the system bus 23.

The interface section 71 is connected to the connector 18 and performs the interface processing so that the CPU 11 transmits/receives the data with the encoder 25 via the connector 18 and the connector 26 connected to the connector 18.

Additionally, in the fifth embodiment, the CPU 11 executes the software processing based on the operation program stored in the ROM 12, and thereby functions not only as the respective processing sections in the first embodiment but also as an encoding section, and collating section.

The encoding section performs the logic operation performed by the encoder 19 in the first embodiment by a software processing.

Moreover, the collating section obtains the response code outputted from the process unit 2 through the interface section 71, and collates the response code with the specific code obtained by the encoding section by the software processing.

That is, in the fifth embodiment, the process unit 2 is identified by the processing similar to that of the first embodiment, and the functions of the encoder 19 and collator 20 are realized by the software processing of the CPU 11.

Also in the fifth embodiment, the identification processing can be performed at various timings as in the first embodiment. Here, the first identification processing will be described.

Figure 18:
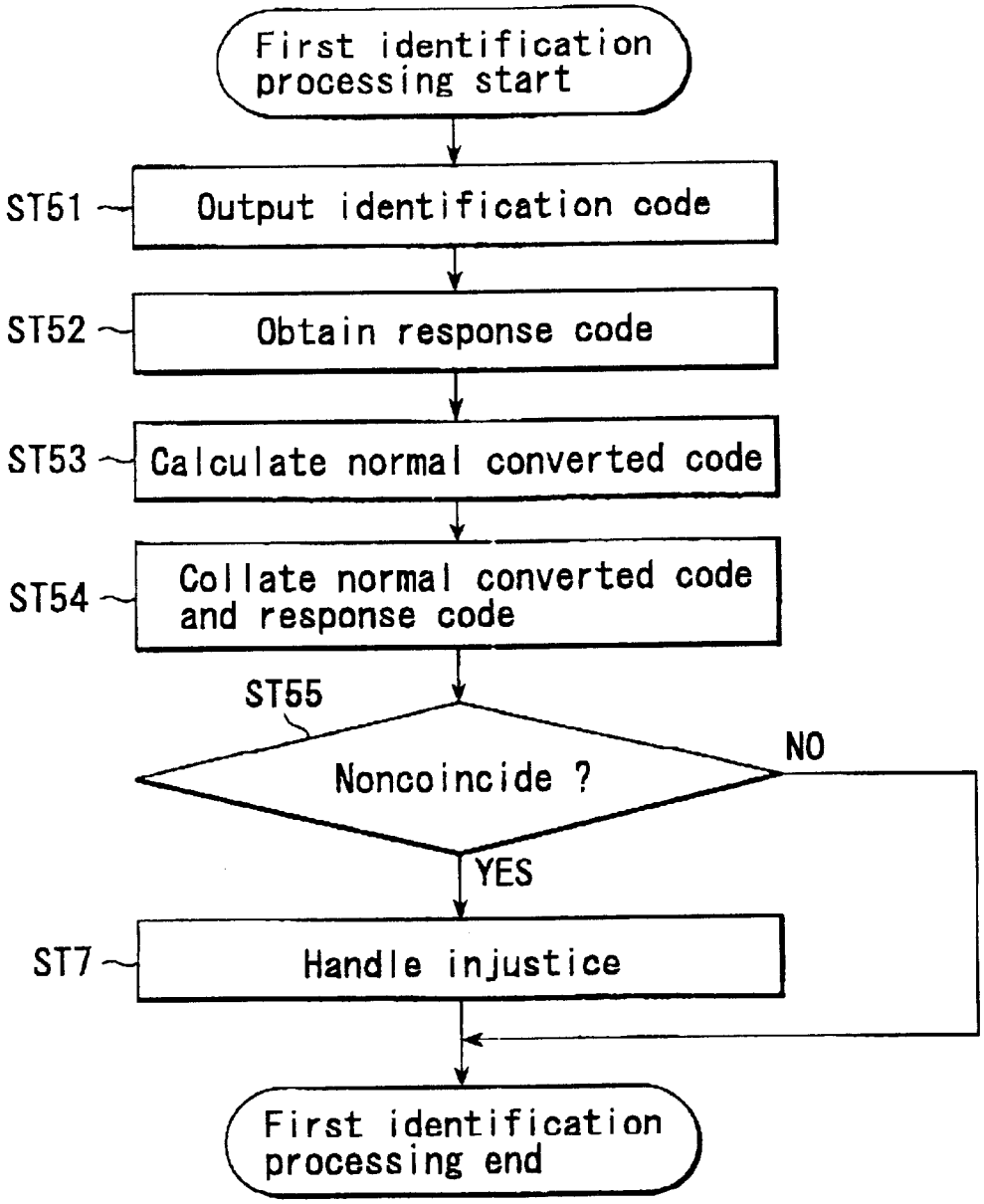
FIG. 18 is a flowchart of a first identification processing by the CPU of FIG. 17.

FIG. 18 is a flowchart of a first identification processing. Additionally, the step of performing the same processing as that of FIG. 3 is denoted with the same reference numeral, and the detailed description thereof is omitted.

As shown in FIG. 18, first in the first identification processing, the CPU 11 outputs the identification code (step ST51). Subsequently, the CPU 11 obtains the response code returned from the process unit 2 in response to the identification code outputted in the step ST51 through the interface section 71 (step ST52).

Subsequently, the CPU 11 calculates the specific code with respect to the identification code outputted in the step ST51 (step ST53), and collates the specific code with the response code obtained the step ST52 (step ST54).

Moreover, the CPU 11 confirms whether or not the collation result in the step ST54 noncoincides (step ST55). Here, if the CPU 11 confirms noncoincidence of the collation result, executes the operation of handling an injustice of step ST7, the CPU11 ends first identification processing when the operation of handling an injustice is completed. On the other hand, if the CPU 11 confirms the coincidence of the collation result in the step ST55, the CPU 11 ends first identification processing without performing the operation of handling an injustice of the step ST7.

As described above, according to the fifth embodiment, the same effect as that of the first embodiment can be obtained. Additionally, a modification in which both the encoders 19 and 25 are replaced with other converters, and a modification in which the collator 20 is replaced with a collator for constantly outputting coincidence data are impossible. Moreover, deception by such injustice can be prevented.

Additionally, the present invention is not limited to the aforementioned respective embodiments. For example, in the respective embodiments, the identifying apparatus of the present invention is provided at the main unit 1, the apparatus to be identified is provided at the process unit 2, and the process unit 2 attached to the main unit 1 is identified. However, the identification object is not limited to the process unit, and the present invention can also be applied to identification of other units such as a toner unit. Moreover, the unit as the identification object is not limited to the consumable item, and the present invention can also be applied to identification of a memory unit or another extension unit. Furthermore, the apparatus is not limited to the digital copying machine. The present invention can be applied to any apparatus, as long as two separate units are arbitrarily attached to the apparatus. Of course, the present invention can also be realized as an independent identifying apparatus and apparatus to be identified which are incorporated in arbitrary apparatuses for use.

Moreover, in the respective embodiments, the logic operation is performed based on the equation shown in FIG. 2B for the code conversion, but the content of the logic operation may be arbitrary.

Furthermore, in the respective embodiments, only one bit of the past code is used in the logic operation for the code conversion, but two or more bits may be used. When the number of bits increases, the relation between the codes before and after the conversion can be complicated. Moreover, the past information for use is not limited to the bit of the last code before the conversion, and the bit of the last but one or more codes before the conversion, or the bit of the past code after the conversion may also be used.

Additionally, in the respective embodiments, the identification processing is performed during power supply, during cover closing, every predetermined periods, or before printing start, but the identification processing may be performed only at some of these timings, or at a timing other than these timings.

Moreover, in the respective embodiments, the identification code or the response code may be exchanged between the main unit 1 and the process unit 2 as the serial signal, but may be exchanged as the parallel signal.

Furthermore, the configuration for changing the logic is not limited to that of the third embodiment, and may be arbitrary. Furthermore, the number of types of usable logic is not limited to two, and three or more types of logic may be used.

Additionally, in the third embodiment, the second logic is selected at a ratio of one per three codes, but a logic selection pattern may be arbitrary.

Moreover, in the fourth embodiment, the second, fourth, sixth, and eighth bits among the eight bits configuring one code are replaced with four bits of random numbers, but the portion to be replaced may be arbitrary. Furthermore, the replacing data is not limited to the random number, and arbitrary data such as fixed data may be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An identifying apparatus, to which a separate apparatus to be identified can arbitrarily be attached, for identifying whether an original apparatus is attached, the identifying apparatus comprising:

an input port which receives an input signal from the separate apparatus, the input signal having a code which changes in accordance with a predetermined pattern;

a collating section which collates whether or not a change pattern of the code in the input signal provided to the input port coincides with a predetermined change pattern; and an identifying section which identifies attachment of the original apparatus only when coincidence is judged by collation by the collating section.

2. An identifying apparatus, to which a separate apparatus to be identified can arbitrarily be attached, for identifying whether an original apparatus is attached, the identifying apparatus comprising:

an input port which receives an input signal from the separate apparatus;

an output port which supplies an output signal to the separate apparatus;

a code generating section which outputs a predetermined identification code through the output port to the separate apparatus;

an encoding section which encodes the predetermined identification code generated by the code generating section to a specific code according to a predetermined rule;

a collating section which collates whether or not the specific code obtained by the encoding section coincides with the input signal provided to the input port; and an identifying section which identifies attachment of an original apparatus only when coincidence is judged by collation by the collating section.

3. The identifying apparatus according to claim 2, wherein the code generating section generates a plurality of types of codes, each different from one another in content, as the identification code, and randomly outputs the plurality of types of codes as the identification code.

4. The identifying apparatus according to claim 3, wherein the code generating section generates the identification code which includes a numeric value indicating at least one of a month, a day, an hour, a minute, and a second in a time of the generation.

5. The identifying apparatus according to claim 2, wherein the code generating section outputs the identification code as a serial signal through the output port.

6. The identifying apparatus according to claim 2, wherein the encoding section comprises:

a latch circuit which latches at least some bits of the identification code which was previously input; and a logic operator which generates the specific code by a predetermined logic operation using respective bits of the latest identification code and the bits latched by the latch circuit.

7. The identifying apparatus according to claim 2, wherein the encoding section comprises an output timing control section which outputs the specific code after a predetermined time has elapsed after the input of the identification code as an original of the specific code.

8. The identifying apparatus according to claim 2, wherein the encoding section encodes the identification code to the specific code according to a plurality of rules, and wherein the identifying apparatus further comprises a rule selecting section which selects any one of the plurality of rules in a predetermined pattern, and outputs the specific code obtained by the encoding section according to the selected rule.

9. The identifying apparatus according to claim 2, wherein the encoding section comprises a replacing section which replaces a predetermined part of the specific code with a dummy code unrelated to the identification code, and the collating section collates the specific code excluding the predetermined part replaced with the dummy code by the replacing section.

10. The identifying apparatus according to claim 2, further comprising an injustice detecting section which monitors whether or not there is a periodic property in the specific code supplied to the collating section or the input signal from the input port, and judging injustice when there is no periodic property.

11. The identifying apparatus according to claim 2, wherein the code generating section, the encoding section, the collating section and the identifying section are realized by a software processing by a single processor.

12. The identifying apparatus according to claim 2, wherein the identifying section performs an identification processing of judging whether the original apparatus to be identified is attached immediately after power supply.

13. The identifying apparatus according to claim 2, wherein the identifying section performs an identification processing of judging whether the original apparatus to be identified is attached, when a predetermined operation is performed in connection with attachment of the apparatus to be identified.

14. The identifying apparatus according to claim 13, wherein the predetermined operation is closing a cover with which the apparatus to be identified.

15. The identifying apparatus according to claim 2, wherein the identifying section performs an identification processing of judging whether the original apparatus to be identified is attached periodically at a predetermined time interval.

16. The identifying apparatus according to claim 2 for use in judging whether an original consumable item is attached to a predetermined apparatus having a consumable item able to be replaced, wherein the identifying section performs an identification processing of judging whether the original apparatus is attached in response to occurrence of a necessity for starting a predetermined operation using the consumable item by the predetermined apparatus.

17. An apparatus to be identified which enables an identifying apparatus to identify attachment of an original apparatus, when the apparatus to be identified is attached to the identifying apparatus comprising:

an input port which receives an input signal from the apparatus to be identified;

a collating section which collates whether or not a change pattern of a code in an input signal from the input port coincides with a predetermined change pattern; and an identifying section which identifies attachment of the original apparatus only when coincidence is judged by collation by the collating section, wherein the apparatus to be identified comprises:

a response signal generating section which supplies a response signal which arranges different codes in the predetermined change pattern every time to the input port.

18. An apparatus to be identified which enables an identifying apparatus to identify attachment of an original apparatus, when the apparatus to be identified is attached to the identifying apparatus comprising:

an input port which receives an input signal from the apparatus to be identified;

an output port which supplies an output signal to the apparatus to be identified;

a code generating section which outputs a predetermined identification code through the output port;

an encoding section which encodes the identification code generated by the code generating section to a specific code according to a predetermined rule;

a collating section which collates whether or not the specific code obtained by the encoding section coincides with the input signal from the input port; and an identifying section which identifies attachment of the original apparatus only when coincidence is judged by collation by the collating section, wherein the apparatus to be identified comprises:

a response code generating section which supplies a response code obtained by encoding the identification code output through the output port of the identifying apparatus according to the same rule as that of the encoding section to the input port.

19. The apparatus to be identified according to claim 18, wherein the response code generating section outputs the response code as a serial signal to the input port.

20. The apparatus to be identified according to claim 18, wherein the response code generating section comprises:

a latch circuit which latches at least some bits of the identification code which was previously input; and a logic operator which generates the response code by a predetermined logic operation using respective bits of the latest identification code and the bits latched by the latch circuit.

21. The apparatus to be identified according to claim 18, wherein the response code generating section comprises an output timing control section which outputs the response code after a predetermined time has elapsed after the input of the identification code as an original of the response code.

22. The apparatus to be identified according to claim 18, wherein the response code generating section encodes the identification code to the response code according to a plurality of rules, and further comprising a rule selecting section which selects any one of the plurality of rules in a predetermined pattern, and outputs the response code obtained by the response code generating section according to the selected rule.

23. The apparatus to be identified according to claim 18, wherein the response code generating section comprises a replacing section configured to replace a predetermined part of the response code with a dummy code unrelated to the identification code.

24. An identifying method for identifying attachment of an original apparatus to be identified in an identifying apparatus to which a separate apparatus to be identified can arbitrarily be attached and which comprises an input port which receives a signal from the apparatus to be identified, the method comprising the steps of:

receiving an input signal from the separate apparatus, the input signal having a code which changes in accordance with a predetermined pattern;

collating whether or not the change pattern of the code in the input signal from the input port coincides with the predetermined change pattern; and identifying the attachment of the original apparatus to be identified only when coincidence is judged.

25. An identifying method for identifying attachment of an original apparatus to be identified in an identifying apparatus to which a separate apparatus to be identified can arbitrarily be attached and which comprises an input port which receives a signal from the apparatus to be identified and an output port which supplies an output signal to the apparatus to be identified, the method comprising the steps of:

outputting a predetermined identification code through the output port;

encoding the identification code to a specific code according to a predetermined rule;

collating whether or not the specific code coincides with the input signal from the input port; and identifying attachment of the original apparatus to be identified only when coincidence is judged.

26. A printing apparatus to which a separate consumable item can arbitrarily be attached and which uses the consumable item to print an image, the printing apparatus comprising:

an input port which receives an input signal from the apparatus to be identified;

a collating section which collates whether or not a change pattern of a code in an input signal from the input port coincides with a predetermined change pattern; and an identifying section which identifies attachment of the original apparatus to be identified only when coincidence is judged by collation by the collating section.

27. The printing apparatus according to claim 26, further comprising a handle injustice section which performs a predetermined warning operation, when the consumable item is attached and the identifying section does not identify the attachment of the original consumable item.

28. The printing apparatus according to claim 26, further comprising a handle injustice section which inhibits printing after execution of a predetermined amount of printing, when the consumable item is attached and the identifying section does not identify the attachment of the original consumable item.

29. The printing apparatus according to claim 26, further comprising a handle injustice section which inhibits printing, when the consumable item is attached and the identifying section does not identify the attachment of the original consumable item.

30. A printing apparatus to which a separate consumable item can arbitrarily be attached and which uses the consumable item to print an image, the printing apparatus comprising:

an input port which receives an input signal from the apparatus to be identified;

an output port which supplies an output signal to the apparatus to be identified;

a code generating section which outputs a predetermined identification code through the output port;

an encoding section which encodes the identification code generated by the code generating section to a specific code according to a predetermined rule;

a collating section which collates whether or not the specific code obtained by the encoding section coincides with the input signal from the input port; and an identifying section which identifies attachment of an original apparatus to be identified only when coincidence is judged by collation by the collating section.

31. The printing apparatus according to claim 30, further comprising a handle injustice section which performs a predetermined warning operation, when the consumable item is attached and the identifying section does not identify the attachment of the original consumable item.

32. The printing apparatus according to claim 30, further comprising a handle injustice section which inhibits printing after execution of a predetermined amount of printing, when the consumable item is attached and the identifying section does not identify the attachment of the original consumable item.

33. The printing apparatus according to claim 30, further comprising a handle injustice section which inhibits printing, when the consumable item is attached and the identifying section does not identify the attachment of the original consumable item.

* * * * *